US005441268A

United States Patent [19]

Shier

[11] Patent Number: 5,441,268

[45] Date of Patent: Aug. 15, 1995

[54] GOLF PUTTING ACCESSORY

[76] Inventor: Ronald G. Shier, P.O. Box 257, Milington, Mich. 48746

[21] Appl. No.: 276,855

[22] Filed: Jul. 18, 1994

[51] Int. Cl.[6] ..... A63B 69/36

[52] U.S. Cl. ..... 273/186.2; 273/194 A

[58] Field of Search ..... 273/192, 194 R, 194 A, 273/163 R, 162 R, 187.4, 186.2, 191 R, 193 A, 194 B, 162 E, 175, 167 R, DIG. 30, 77 R

[56] References Cited

U.S. PATENT DOCUMENTS

| | | | |
|---|---|---|---|
| 1,939,414 | 12/1933 | Sametz | 273/194 A |
| 3,021,141 | 2/1962 | Polsky | 273/186.2 |
| 3,039,776 | 6/1962 | Faini | 273/186.2 |
| 3,194,564 | 7/1965 | Swan | 273/186.2 |
| 3,667,761 | 6/1972 | Palotsee . | |
| 3,810,633 | 5/1974 | Scott, III . | |
| 3,844,569 | 10/1974 | Swanson . | |
| 4,085,936 | 4/1978 | Patterson | 273/186.2 |
| 4,139,198 | 2/1979 | Kanavas | 273/186.2 |
| 4,174,838 | 11/1979 | Paschetto . | |
| 4,291,883 | 9/1981 | Smart et al. . | |
| 4,323,246 | 4/1982 | Nehrbas | 273/186.2 |
| 4,601,472 | 7/1986 | O'Flanagan . | |
| 4,819,943 | 4/1989 | Szczepanski . | |
| 4,842,280 | 6/1989 | Hilton | 273/DIG. 30 |
| 4,846,477 | 7/1989 | Phelan | 273/186.2 |
| 4,944,517 | 7/1990 | Redkey . | |
| 5,011,153 | 4/1991 | Watkins | 273/186.2 |
| 5,022,656 | 6/1991 | Tiller . | |
| 5,135,229 | 8/1992 | Archer | 273/186.2 |
| 5,160,142 | 11/1992 | Marshall . | |

FOREIGN PATENT DOCUMENTS

| | | | |
|---|---|---|---|
| 2196859 | 5/1988 | United Kingdom | 273/186.2 |

*Primary Examiner*—Sebastiano Passaniti

*Attorney, Agent, or Firm*—Gifford, Krass, Groh, Sprinkle, Patmore, Anderson & Citkowski

[57] ABSTRACT

A golf putting accessory for use with a golf putter. A body is constructed of a substantially flat and elongated member which conforms to an outline of a golf putter head. A first guiding portion and a second guiding portion extend from the body in proximity to a putter face of the golf putter head and define a centrally disposed open length along the putter face for striking a golf ball. A first strap and a second strap extend from the body and loop around the putter head to secure the device to the putter head.

12 Claims, 2 Drawing Sheets

GOLF PUTTING ACCESSORY

BACKGROUND OF THE INVENTION

1. Field of the Invention

The present invention relates generally to golf putting training devices and, more particularly, to an accessory for use with a golf putter which limits the area along a putter face for striking a golf ball to a central portion of the face to assist the golfer in improving his or her putting stroke.

2. Description of the Prior Art

Putting accessory devices are well known in the art for improving the putting stroke of a golfer. The goal of a putting accessory device is to train the golfer to strike the ball squarely with the center of the putter face.

U.S. Pat. No. 3,844,569, issued to Swanson, teaches a device for use in developing a square putting stroke. Swanson teaches a spring clamp attachment for a putter head with a pair of extending arms. The arms cooperate with a rod surface laying on the ground (the shaft of another golf club) so as to hold the putter face perpendicular to the axis of the shaft during the putting stroke.

U.S. Pat. No. 4,601,472, issued to O'Flanagan, teaches a sighting device for a golf putter mounted to the putter head and having an eye aligning mirror. The mirror reflects the ball to be struck so that the ball is centered with respect to the putter head.

While the prior art devices provide unique ways in which to train the golfer in the putting stroke, the shortcoming of such devices is that they do not provide a simple yet effective way to insure that the golf ball is struck only by the central portion of the putter face.

SUMMARY OF THE PRESENT INVENTION

The present invention is an accessory for use with a golf putter for striking a golf ball. The golf putter has a golf putter head with a putting face and a shaft connected to the golf putter head. The accessory includes a body shaped as a flat and elongated member which conforms to the outline of the putter head. A first guiding portion and a second guiding portion extend from the elongated member in proximity to the putting face and limit the area of the putter face which can strike the golf ball to a central area of the putter face. A pair of straps extend from the body and loop around the putter head to secure the accessory to the putter head. In a further embodiment, first and second gripping members extend from opposite ends of the guiding portions and engage opposite sides of the putter head to provide added support to the putting accessory.

BRIEF DESCRIPTION OF THE DRAWING

Reference is made to the attached drawing, when read in combination with the following specification, wherein like reference numerals refer to like parts throughout the several views, and in which.

DESCRIPTION OF THE PREFERRED EMBODIMENTS

Figure 1:
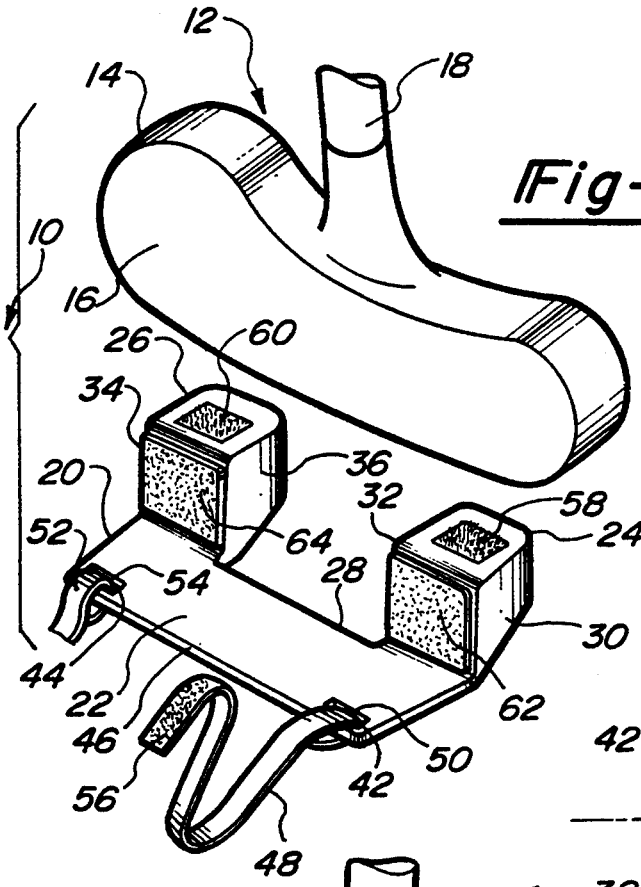
FIG. 1 is a perspective view of the golf putter accessory according to a first preferred embodiment.
Figure 2:
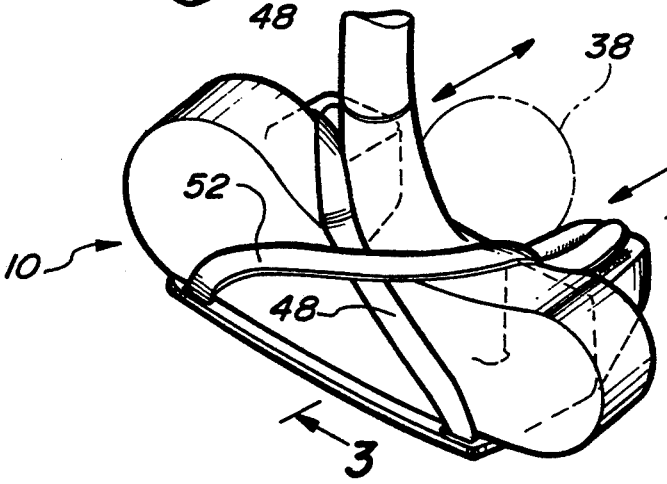
FIG. 2 is a view similar to that shown in FIG. 1 and showing the putter accessory attached to the golf putter head.

Referring to FIGS. 1 and 2, a golf putting accessory 10 for use with a golf putter 12 is shown. The golf putter 12 typically has a golf putter head 14 with a putting face 16. A shaft 18 attaches to the golf putter head 14 as is commonly known in the art.

The golf putting accessory 10 includes a body 20 constructed of a flat and elongated member 22. The flat and elongated member 22 is constructed of a durable and pliable material such as an aluminum or a plastic. However, the elongated member 22 can be constructed of any desired material which exhibits the necessary characteristics. The elongated member 22 bends to conform to the bottom contour of the putter head when the accessory is attached, as is shown in FIG. 2 and will be subsequently described.

A first guiding portion 24 and a second guiding portion 26 extend from the elongated member 22 in proximity to the putter face 16 of the putter 12. Each of the guiding portions 24 and 26 extend upwardly from a front edge 28 of the flat and elongated member 22, with the guiding portion 24 having an outer surface 30 and inner surface 32 and the guiding portion 26 having an outer surface 34 and an inner surface 36.

The outer surfaces 30 and 34 of the guiding portions 24 and 26 are arcuately shaped and the inner surfaces 32 and 36 are shaped substantially vertical. The guiding portions 24 and 26 are spaced a predetermined distance apart, preferably $2\frac{1}{4}''$, in order to permit a typically $1\frac{3}{4}''$ diameter ball 38 to locate between the guiding portions with at least a $\frac{1}{4}''$ clearance between each side of the golf ball 38 and the guiding portions. The guiding portions 24 and 26 each also have an upwardly angled bottom surface 40 which helps to avoid undesirable contact between the putting accessory and the ground surface while the putter is being swung through the putting stroke.

Figure 3:
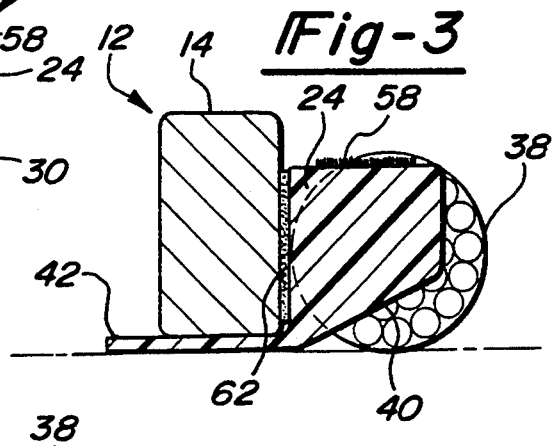
FIG. 3 is a view taken along lines 3—3 of FIG. 2 and showing a side view of the golf putter accessory of the present invention.

Referring again to FIGS. 1 and 2, and to FIG. 3, a pair of apertures 42 and 44 are formed along a rear edge 46 of the flat and elongated member 22. A first strap 48 is looped at end 50 to connect to the first aperture 42. A second strap 52 is looped at end 54 to connect to second aperture 44.

The straps 48 and 52 are of a length sufficient to enable them to be wound around the putter head and the putting accessory. Preferably, the straps 48 and 52 are wound in the criss-cross fashion shown in FIG. 2. A first strip of Velcro material 56 is attached to the free end of the straps 48 and 52. While only the full length of the strap 48 is shown in FIG. 1, it is understood that a similar strip of material 56 is applied to a corresponding free end of the strap 52, as is more apparent from FIG. 2.

The straps 48 and 52 are each constructed of a flexible and elastic material which enables them to be wound around the putter head and to be drawn tight so as to be secured in a manner to prevent the accessory from being loosely attached to the putter head. A corresponding Velcro portion 58 is located atop the guiding portion 24 and a like Velcro portion 60 is located atop the guiding portion 26. The mating of the Velcro portions 56 of the straps 48 and 52 with the Velcro portions 58 and 60 provide for the attachment of the putter accessory to the putter head. The term Velcro portions is intended to describe synthetic materials often in the form of hook and loop fastening tapes which adhere when pressed together.

A first cushioning portion 62 is mounted to the guiding portion 24 and a second cushioning portion 64 is mounted to the guiding portion 26 in proximity to the putter face 16 to cushion the contact of the putter face of the golf putter with the putting accessory. The cushioning portions work in combination with the elastic straps and the pliable flat and elongated member to securely attach the putting accessory to the putter head as can be clearly seen in FIG. 2.

Figure 4:
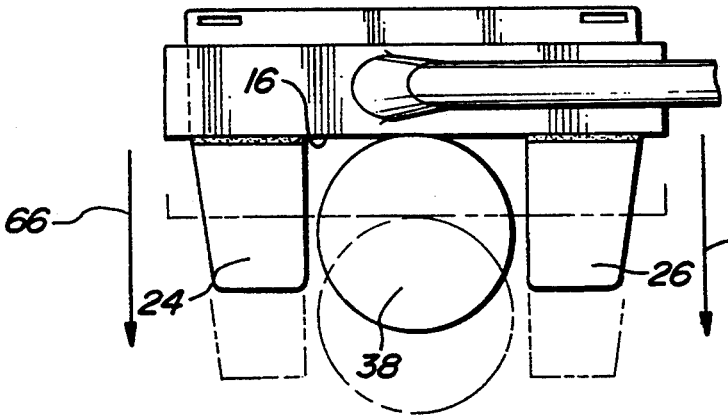
FIG. 4 is a top view of the golf putter accessory according to the first preferred embodiment.

Referring further to FIG. 4, a top view of the putter accessory for locating the golf ball to a central portion of the putter face is shown. As can be clearly seen from FIG. 4, the golf ball 38 is contacted by the putting face 16 of the putter and is located between the guiding portions 24 and 26 as the putter is swung in the direction of arrows 66. The putter head and attached putter accessory is shown in solid at the point where the putter first contacts the ball and in phantom as the putter proceeds through the putting stroke. As can be further seen in FIG. 4, the ball 38 remains centrally positioned vis-a-vis the putting face to improve the putting stroke.

Figure 5:
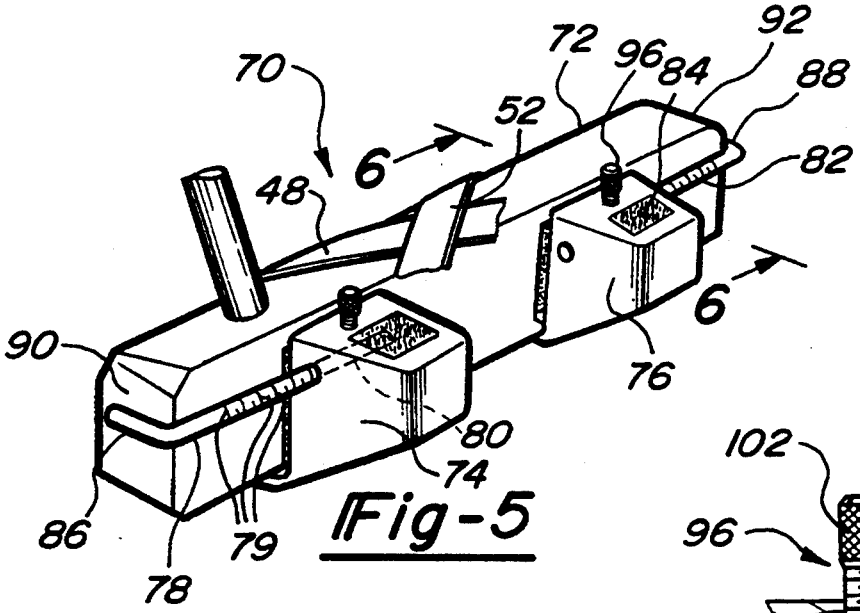
FIG. 5 is a perspective view of the golf putter accessory according to a second preferred embodiment.

Referring further to FIG. 5, a putting accessory 70 according to a second preferred embodiment is shown. The putting accessory 70 according to the second preferred embodiment is identical to the first preferred embodiment in most respects, aside from the fact that it can be used with a uniquely shaped putter 72 having a long rectangular putting head. The putting accessory according to either the first or second preferred embodiments is capable of being attached to most any conventional putter currently on the market.

A first guiding portion 74 and a second guiding portion 76 is identical to the guiding portions 24 and 26 of the first preferred embodiment. A first gripping member 78 extends from a horizontally formed hollow sleeve 80 in the first guide portion 74 and a second gripping member 82 extends from a horizontally formed sleeve 84 in the second guide portion 76. The first gripping member 78 has an angled end 86 and the second gripping member 82 has an angled end 88. The angled ends 86 and 88 grip opposite sides 90 and 92 of the putter head 72 to more securely maintain the putting accessory on the putter head in combination with the straps. The gripping members 78 and 82 are marked at ⅛" intervals, as shown at 79, to ensure that longer putters are accurately located within the accessory.

Figure 6:
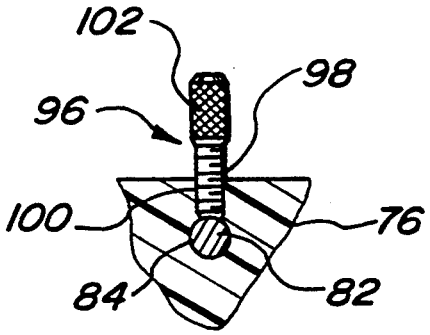
FIG. 6 is a view taken along lines 6—6 of FIG. 5 and illustrating the locking screw used with the golf putter accessory according to the second preferred embodiment.

Referring again to FIG. 5, and further to FIG. 6, a locking screw 94 extends from the guide portion 74 and a locking screw 96 extends from the guide portion 76. The locking screws 94 and 96 are externally threaded, as shown by threads 98 of locking screw 96 in FIG. 6. The locking screws 94 and 96 each extend into hollow internally threaded apertures which each extend at an angle with respect to the internally threaded sleeves 80 and 84 of the guide portions. Referring again to FIG. 6, internally threaded aperture 100 extends substantially perpendicularly to hollowed sleeve 84 through which the gripping member 82 passes. The locking screws 94 and 96 each have a knurled end 102 which enable the screws to be tightened and to engage against the gripping members. The angled ends of the gripping members are accordingly maintained at a predetermined length away from the guiding portions so as to securely maintain the golf putter head therebetween.

Accordingly, the present invention provides a novel and convenient accessory for helping a golfer improve his putting stroke by forcing the golfer to strike the golf ball with the central portion of the golf putter face. Additional embodiments will become apparent to those skilled in the art upon reference to the appended claims.

I claim:

1. An accessory for use with a golf putter for striking a golf ball, the golf putter having a golf putter head with a putting face and a shaft connected to the golf putter head, said accessory comprising:

a body;

means for attaching said body to the golf putter head including a pair of straps extending from said body; and said body including a first guiding portion and a second guiding portion for limiting the golf ball to strike a central portion of the putting face;

a first of said straps looping around the putter head and attaching to one of said guiding portions, a second of said straps looping around the putter head and attaching to the other of said guiding portions, said first strap and said second strap being adjustable to secure said accessory to golf putter heads of varying shapes and sizes.

2. The golf putting accessory as described in claim 1, said body having a substantially flat and elongated member, said first guiding portion extending from said body at a first location in proximity to the putting face, said second guiding portion extending from said body at a second location in proximity to the putting face.

3. The golf putting accessory as described in claim 2, wherein said first guiding portion and said second guiding portion each comprise an outer surface and an inner surface, said inner surface of said first guiding portion is arranged opposite said inner surface of said second guiding portion to define an open length along the putter face capable of receiving the golf ball.

4. The golf putting accessory as described in claim 3, further comprising a first cushioning portion and a second cushioning portion extending from said first guiding portion and said second guiding portion respectively and contacting the face of the golf putter head.

5. The golf putting accessory as described in claim 1, wherein said straps each comprise first hook and loop fastening materials secured to their ends, said first hook and loop fastening materials engaging second hook and loop fastening materials secured to said first guide portion and said second guide portion.

6. The golf putting accessory as described in claim 1, further comprising means for adjusting the position of said first guiding portion and said second guiding portion along the golf putter face.

7. The golf putting accessory as described in claim 6, wherein said means for adjusting comprises a first gripping member extending from said first guiding portion and engaging a first side of the golf putter head and a second gripping member extending from said second guiding portion and engaging a second side of the golf putter head.

8. The golf putting accessory as described in claim 7, further comprising internally threaded apertures formed through said first guiding portion and said second guiding portion, an externally threaded locking screw being threadably engaged within said internally threaded apertures to engage said guiding portions located within said hollow sleeves.

9. The golf putting accessory as described in claim 1, wherein said first guiding portion is spaced two and one quarter inches from said second guiding portion in proximity to the putting face.

10. The golf putting accessory as described in claim 1, wherein said body has a substantially flat and elongated member and is constructed of a durable and pliable material which conforms to the outline of the golf putter head.

11. The golf putting accessory as described in claim 1, wherein said first guiding portion and said second guiding portion each have an arcuately shaped outer surface and a vertically extending inner surface and are constructed of a durable material.

12. An accessory for use with a golf putter for striking a golf ball, the golf putter having a golf putter head with a putting face and a shaft connected to the golf putter head, said accessory comprising:

a body;

means for attaching said body to the golf putter head;

said body including a first guiding portion and a second guiding portion for limiting the golf ball to strike a central portion of the putting face;

a first gripping member extending from said first guide portion and engaging a first side of the golf putter head and a second gripping member extending from said second guide portion and engaging a second side of the golf putter head, said first gripping member and said second gripping member adjusting the position of said first guiding portion and said second guide portion along the golf putter face; and internally threaded apertures formed through said first guiding portion and said second guide portion, an externally threaded locking screw being threadably engaged within each said internally threaded apertures to engage said guiding portions located within said hollow sleeves.

* * * * *

UNITED STATES PATENT AND TRADEMARK OFFICE

CERTIFICATE OF CORRECTION

PATENT NO. : 5,441,268
DATED : August 15, 1995
INVENTOR(S) : Ronald G. Shier

It is certified that error appears in the above-indentified patent and that said Letters Patent is hereby corrected as shown below:

Column 6, line 13, delete "guide" and insert --guiding--;

line 16, delege "guide" and insert --guiding--.

Signed and Sealed this

Fourteenth Day of November, 1995

*Attest:*

*Attesting Officer*

BRUCE LEHMAN

*Commissioner of Patents and Trademarks*